US005179853A

United States Patent [19]

Nicoletti

[11] Patent Number: 5,179,853

[45] Date of Patent: Jan. 19, 1993

[54] METHOD TO MANUFACTURE SEALING NIPPLES OR PLUGS

[75] Inventor: Bruno Nicoletti, Sasso Marconi, Italy

[73] Assignee: Lolli Valter, Di Reno, Italy

[21] Appl. No.: 658,318

[22] Filed: Feb. 20, 1991

[30] Foreign Application Priority Data

Feb. 21, 1990 [IT] Italy ..... 3352 A/90

[51] Int. Cl.[5] ..... B21D 53/24

[52] U.S. Cl. ..... 72/333; 72/348

[58] Field of Search ..... 72/333, 336, 348, 352, 72/356; 220/288; 10/86 C

[56] References Cited

U.S. PATENT DOCUMENTS

| | | | |
|---|---|---|---|
| 406,479 | 7/1889 | Schrader et al. | 72/336 |
| 808,177 | 12/1905 | Thiem | 10/86 C |
| 1,125,229 | 1/1915 | Webster | 220/288 |
| 1,142,302 | 6/1915 | Carlson . | |
| 1,803,022 | 4/1931 | Kowal | 72/348 |
| 1,876,304 | 9/1932 | Kramer | 220/288 |
| 2,770,260 | 11/1956 | Henderson | 220/288 |
| 3,000,424 | 9/1961 | Weise . | |
| 3,688,717 | 9/1972 | Rudolph et al. | 72/356 |

FOREIGN PATENT DOCUMENTS

| | | |
|---|---|---|
| 0049020 | 9/1981 | European Pat. Off. . |
| 980147 | 1/1965 | United Kingdom . |

*Primary Examiner*—Lowell A. Larson
*Attorney, Agent, or Firm*—Darby & Darby

[57] ABSTRACT

The method to manufacture sealing nipples or plugs comprises a cutting process of a disk-shaped element from a metal sheet followed by drawing of the disk to obtain a hollow element of cylindrical shape, closed at one end by a cap, and then pressing the hollow element to form an annular crown on the outer peripheral surface of it.

Lastly the threading of at least a portion of the outer peripheral surface starting from the open end, is carried out.

5 Claims, 2 Drawing Sheets

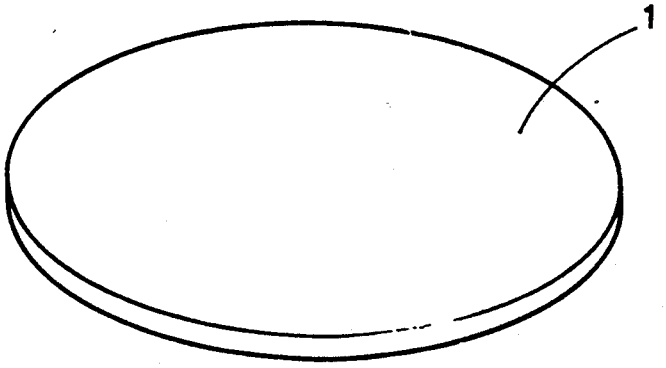
Fig.1
Fig. 2
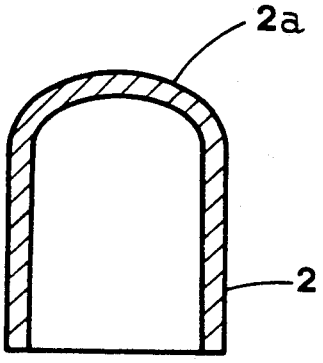
Fig.3a
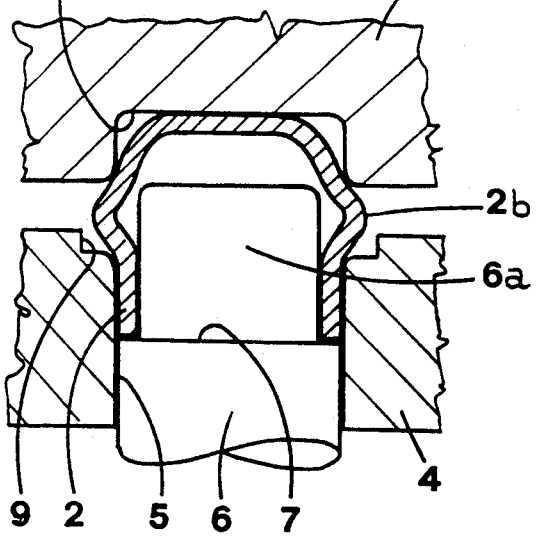
Fig.3b
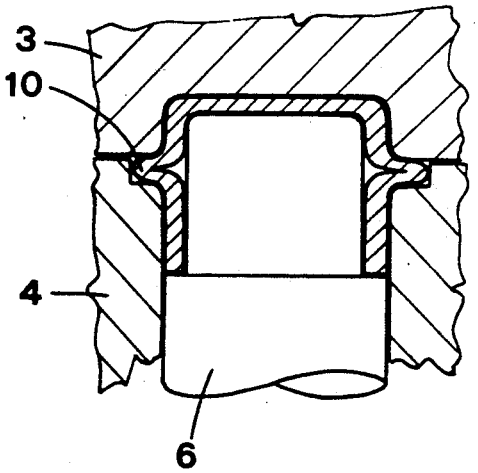

Fig. 4
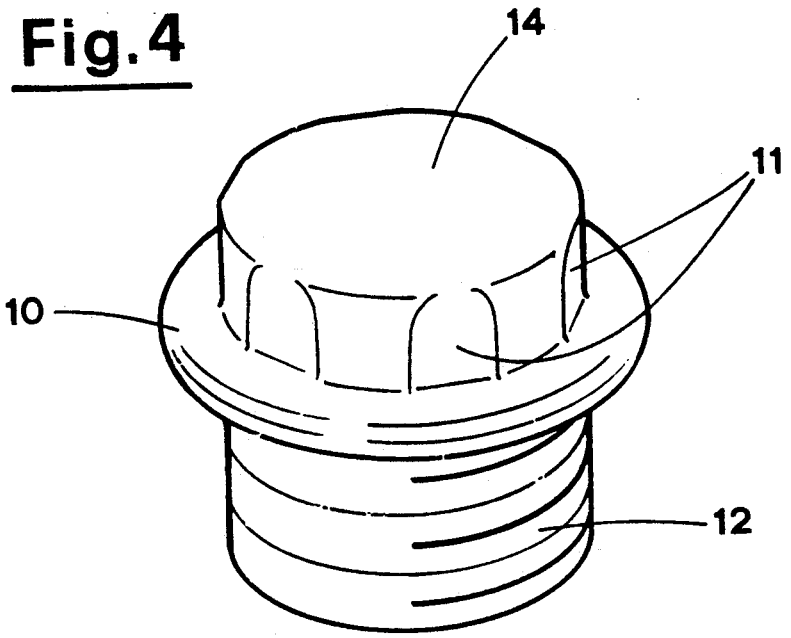
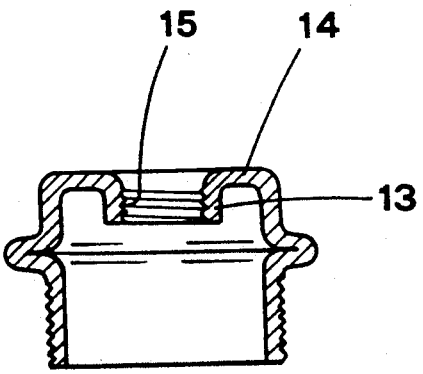
Fig. 5
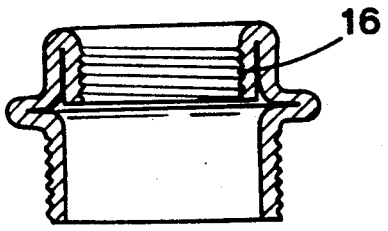
Fig. 6

METHOD TO MANUFACTURE SEALING NIPPLES OR PLUGS

BACKGROUND OF THE INVENTION

This invention relates to the technical field concerning the manufacture of sealing nipples or plugs, particularly for radiators.

DESCRIPTION OF THE PRIOR ART

It is known that the radiators of the common liquid heating systems are fitted with plugs and metal nipples, used to close at one end the hydraulic circuit formed by the heating elements associated together and at the other end for connection with the hot-water delivery pipe.

Said plugs are threaded externally, to be screwed on the radiators, and are shaped in such a way as to allow the mounting of a suitable seal gasket, matching an external annular shoulder. The screwing of the plugs may be carried out by means of a special wrench tool, catching an end of the same plugs shaped with a prismatic contour.

At present, said plugs are made by die-casting or other equivalent methods. Said manufacturing methods provide a reliable product, but one which is relatively expensive, in reliable to its use.

SUMMARY OF THE INVENTION

An object of the present invention is the provision of a method which allows to manufacture sealing nipples or plugs starting from a metal sheet.

A further object is the provision of a method to manufacture sealing nipples or plugs through a technical solution which turns out to be simple, highly functional and reliable, as well as relatively inexpensive.

The above-mentioned objects are achieved through a method to manufacture sealing nipples or plugs that comprises a cutting process of a disk-shaped element from a metal sheet followed by drawing of the disk to obtain a hollow element of cylindrical shape, closed at one end by a cap, and then pressing the hollow element to form an annular crown on the outer peripheral surface of it.

Lastly the threading of at least a portion of the outer peripheral surface starting from the open end, is carried out.

BRIEF DESCRIPTION OF THE DRAWINGS

The present invention will be described further, by way of example, with reference to the accompanying drawings, wherein:

FIG. 1 is a perspective view of a disk obtained by said cutting process;

FIG. 2 is an axial cutaway view of the hollow element obtained by said drawing process;

FIGS. 3*a* and 3*b* are axial cutaway views of successive phases of said pressing process;

FIG. 4 is a perspective view of a plug manufactured through the method conforming to the invention;

FIGS. 5 and 6 are respectively axial cutaway views of different embodiments of a nipple made by said method.

DESCRIPTION OF THE PREFERRED EMBODIMENT

Referring to the drawings, the method conforming to the invention provides, first of all, for cutting a disk-shaped element 1 from a metal sheet (FIG. 1).

Subsequently, the disk 1 undergoes a drawing process by which is obtained a hollow element 2 of cylindrical shape closed at one end by a cap 2*a*, basically part spherical (FIG. 2). The hollow element 2 is then suitably trimmed along its circular edge, through known techniques.

Subsequently, the hollow element 2 undergoes a pressing process inside a die made up of a movable part 3 and of a stationary counter-die 4.

The counter-die 4 features a hole 5 housing a punch 6, stationary with respect to the same counter-die. The punch 6 features, starting from a shoulder 7, a head 6*a* of smaller diameter.

Between the head 6*a* of the punch 6 and the peripheral surface of the hole 5 is defined an annular seating into which may be inserted the hollow element 2 to be pressed, matching the shoulder 7 and with the cap 2*a* turned outwards.

The head 6*a* of the punch 6 is partially projecting from the upper surface of the counter-die 4, and it is suited to cooperate with a cavity 8 correspondingly provided in the movable die 3; the cavity 8 has the same diameter as the hole 5 and has the peripheral surface suitably faceted, as pointed out hereinafter. Furthermore, the hole 5 is edged with a step-shaped annular groove 9, on its outer edge.

Therefore, when the movable die 3 is forced against the counter-die 4, the cap 2*a* of the hollow element 2 is progressively forced into the hollow 8, as shown in FIG. 3*a*. At the same time, the axial compression of the cavity element 2 brings about a fold 2*b* of the outer peripheral surface of the same hollow element 2, in the zone where said surface is not locked in the seating defined between the hole 5 and the punch head 6*a*.

At the end of the pressing process, the punch 6 fits with its head 6*a* into the inner surface of the cap 2*a*, completing its forming inside the hollow 8, as shown in FIG. 3*b*. At the same time, the fold 2*b* is forced into the annular groove 9 by the movable die 3, so as to form, on the peripheral surface of the hollow element 2, an annular crown 10.

It should be appreciated that the pressing stage also produces, on the peripheral surface at the rear of the crown 10, a series of facets 11, visible in FIG. 4, which shows the plug made according to the method conforming to the invention. Said facets 11, corresponding to the internal profile of the cavity 8, provide a prismatic profile which is suited to be engaged by a special tool for screwing the plug.

After the extraction from the die, the plug undergoes a threading of the portion 12 of the peripheral surface between the crown 10 and the free end.

In conclusion, the method described above makes it possible to manufacture sealing plugs, e.g. for radiators and the like, starting from a metal sheet, with a reduction of production costs.

Furthermore, the plugs are manufactured with a limited number of simple mechanical workings. In particular, the workings make it possible to obtain, on the outer surface of the plugs, an annular crown designed to match, on assembly, a conventional seal gasket.

Starting from the plug described above, it is also possible to make nipples, as illustrated in FIGS. 5 and 6. The manufacture of the nipple shown in FIG. 5 provides for forming an inward folded portion 13, starting from a hole made in the bottom 14 of the plug, that is to say in the cap 2*a*.

The folded portion 13 is coaxial to the outer peripheral surface and features, made subsequently, an inner threading 15.

Therefore, the nipple makes it possible to join a pipe, screwed in the inner threading 15, with the element on which the outer threading 12 is screwed.

According to the embodiment illustrated in FIG. 6, the portion bearing the inner threading 16, is folded inwards close to the peripheral surface of the nipple. In that case, the inner threading of the nipple allows the screwing to a pipe of larger diameter than in the previous case of FIG. 5.

It is understood that the above has been described by way of example and it is not restrictive, therefore any other possible embodiment is to be considered as covered by the patent hereby applied for, as described above and as claimed hereinafter.

What is claimed is:

1. A method of manufacturing sealing plugs comprising the steps of:

cutting a disk-shaped element from a metal sheet;

drawing said disk to obtain a hollow element of cylindrical shape, closed at one end by a cap;

inserting said hollow element between a die including a movable part and a stationary counter-die part, said stationary counter-die having a hole housing a punch that defines with respect to the peripheral surface of said hole, an annular seating into which said hollow element is inserted with said cap turned outward; toward said movable die part, said counter-die also having a groove surrounding said hole, said movable die part also having a cavity with a prismatic profile into which said cap fits, moving said die parts relative to each other to press said hollow element so that said punch partially inserts into said movable die cavity to produce on said cap of said hollow element a series of facets with said prismatic profile, said pressing producing an axial compressing of said hollow element to fold said hollow element into said groove of said counter-die, continuing said pressing to close said fold to form an outwardly extending annular crown on the outer peripheral surface of said hollow element below said prismatic profile of said cap; and threading at least a portion of the free end of said hollow element below said crown starting from the open end of said hollow element.

2. A method according to claim 1, wherein said punch comprises a head of smaller diameter starting from a shoulder and partially projecting above an upper surface of said counter-die, said head defining, with respect to the peripheral surface of said hole, an annular seating into which may be inserted said hollow element to be pressed, engaging the shoulder of said punch and with said cap turned outwards.

3. A method according to claim 1 further comprising the steps of:

making a hole on said cap and forming a portion folded inwards starting from said hole;

threading at least a portion of said outer peripheral surface starting from an open end of said hollow element and at least a part of the inner surface of said inwardly folded portion.

4. A method according to claim 3, wherein, said folded portion is coaxial to the outer peripheral surface.

5. A method according to claim 3, wherein said portion bearing the inner threading is folded inwards close to the interior of said outer peripheral surface.

* * * * *